US008201548B2

(12) United States Patent
van Taack-Trakranen et al.

(10) Patent No.: US 8,201,548 B2
(45) Date of Patent: Jun. 19, 2012

(54) POWER TOOL STAND AND TOOL COUPLING FOR MOUNTING A PORTABLE POWER TOOL ON THE STAND

(75) Inventors: John van Taack-Trakranen, Munich (DE); Christian Sattler, Bissenhofen (DE); Markus Jocham, Amtzell (DE)

(73) Assignee: Hilti Aktiengesellschaft, Schaan (LI)

( * ) Notice: Subject to any disclaimer, the term of this patent is extended or adjusted under 35 U.S.C. 154(b) by 887 days.

(21) Appl. No.: 12/291,895

(22) Filed: Nov. 14, 2008

(65) Prior Publication Data

US 2009/0145417 A1 Jun. 11, 2009

(30) Foreign Application Priority Data

Dec. 6, 2007 (DE) ..... 10 2007 055 716

(51) Int. Cl.
*B24B 23/00* (2006.01)

(52) U.S. Cl. ..... 125/36; 451/358

(58) Field of Classification Search ..... 451/358, 451/359, 360, 361; 125/36, 20
See application file for complete search history.

(56) References Cited

U.S. PATENT DOCUMENTS

| | | | | |
|---|---|---|---|---|
| 3,464,655 | A * | 9/1969 | Schuman | 248/651 |
| 4,500,235 | A * | 2/1985 | Johnsen | 408/238 |
| 4,540,149 | A | 9/1985 | Rupprecfht | |
| 5,302,045 | A | 4/1994 | Johnsen | |
| 6,568,876 | B2 * | 5/2003 | Augustin | 403/374.5 |

* cited by examiner

*Primary Examiner* — Robert Rose
(74) *Attorney, Agent, or Firm* — Abelman, Frayne & Schwab

(57) ABSTRACT

A power tool stand includes a guide carriage (4), and a tool coupling (1) for a portable power tool (3) and including a carriage coupling member (1*a*) provided on the guide carriage (4), having a clamping surface (5*a*), two hooks (7*a*, 7*b*) spaced from each other along the clamping surface (5*a*) with at least the first hook (7*a*) being displaceable along the clamping surface (1*a*), and connectable with a tool coupling member (1*b*) for the power tool (3) and having a clamping surface (5*b* the tool coupling member (1*b*) having two free-lying, arranged at least partially circumferentially, bolts (6) which can be hanged behind the two associated hooks (7*a*, 7*b*) of the carriage coupling member (1*a*).

18 Claims, 1 Drawing Sheet

POWER TOOL STAND AND TOOL COUPLING FOR MOUNTING A PORTABLE POWER TOOL ON THE STAND

BACKGROUND OF THE INVENTION

1. Field of the Invention

The present invention relates to a power tool stand and a tool coupling for mounting a portable power tool, in particular, a core drilling tool for drilling concrete and brickwork on the stand.

2. Description of the Prior Art

During core drilling of stone and the like, the necessary high torques and displacement forces are usually applied by the power tool to the power tool stand that is fixedly connected with a constructional component. The forces, which are applied by the power tool, are transmitted in the constructional component via a displaceable guide carriage which includes tool coupling means for a central attachment of the power tool, symmetrically to a guide rail and further, via a bottom plate.

German Publication DE 32 37 057 discloses mounting, on a guide rail of a power tool stand, of a displaceable guide carriage having a carriage coupling member with a clamping surface. A tool coupling member, which is associated with the carriage coupling member, is connectable therewith, and has a clamping surface that cooperates with the clamping surface of the carriage coupling member, provides for mounting of the power tool on the carriage. The tool coupling member has an acute, exposed, and projecting nose that engaging (at a conventional mounting) in a lower portion of the carriage coupling member, provides for hanging of the power tool on the carriage coupling member. The power tool is then pivoted in its locking position and is locked. The power tool can be reliably secured with an insertable lever that eccentrically displaces free-lying, circumferentially arranged bolts of the carriage coupling member.

An object of the present invention is a power tool stand and a tool coupling therefor having a smaller and less extending tool coupling member.

Another object of the present invention is to provide for a technologically easy manufacturing, in particular, of the tool coupling member.

SUMMARY OF THE INVENTION

These and other objects of the present invention, which will become apparent hereinafter, are achieved by providing a power tool stand including a guide carriage, and a tool coupling for a portable power tool and having a carriage coupling member provided on the guide carriage and which has a clamping surface and two hooks spaced from each other along the clamping surface, with at least the first hook being displaceable along the clamping surface. The tool coupling further has a tool coupling member for the power tool and which has a clamping surface and is connectable with the carriage coupling member, with the tool coupling member having two free-lying, arranged at least partially circumferentially, bolts which can be hanged behind the two associated hooks of the carriage coupling member With the tool coupling member having two free-lying arranged at least partially circumferentially, bolts which can be hanged behind the two associated hooks of the carriage coupling member, an exposed projecting nose can be eliminated, which permits to make the tool coupling member smaller and at least partially integrate it in the interior of the power tool. Further, even in the non-locking position, with the tool coupling member having two bolts, the power tool is supported at two points and, thus, is unpivotably supported on the stand. The manufacturing of the tool coupling member is technologically simple as bolts are standard parts and should be secured so that they lie freely and at least partially circumferentially and only slightly loaded, e.g., in holes of two parallel to each other plates of the tool coupling member.

Advantageously, the first hook is displaceable by an eccentric mechanism, whereby locking is effected automatically.

Advantageously, the eccentric mechanism is formed of a cylindrical sleeve and an eccentric bolt displaceable therein and having, advantageously, a radial helical contact surface which provides for application thereto of high locking forces which do not cause any significant wear.

Advantageously, the eccentric mechanism includes a lever receptacle for receiving a lever therein. Thereby, at a corresponding use, the lever itself can be removed and is not damaged.

Advantageously, the first hook is provided on a pivotal lever that is pivoted by the eccentric mechanism, which insures transmission of a locking force.

Advantageously, the second hook is fixedly secured on the carriage coupling member, which insures an easy mounting of the second hook, e.g., by screwing it in.

Advantageously, the clamping surfaces of the carriage coupling member and the tool coupling member are inclined toward a displacement direction of the guide carriage. Thereby, in applications when the carriage is displaced in a horizontal direction, water, which can accumulate on the clamping surfaces, automatically flows away.

Advantageously, on both the tool coupling member and the carriage coupling member, there are provided, respectively, oppositely arranged guide surfaces extending perpendicular to respective clamping surfaces. Thereby, the operational axis of the power tool is positioned, relative to the displacement direction of the guide carriage in a predetermined manner.

Generally, the carriage coupling member is an integral component of the guide carriage. However, advantageously, there are provided T-head elements for connecting the carriage coupling member with the guide carriage and which engage in T-shaped transverse grooves formed in the guide carriage and extending perpendicular to a displacement direction of the guide carriage. Thereby, adjustment of the position of the carriage coupling member on a separate guide carriage becomes possible.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
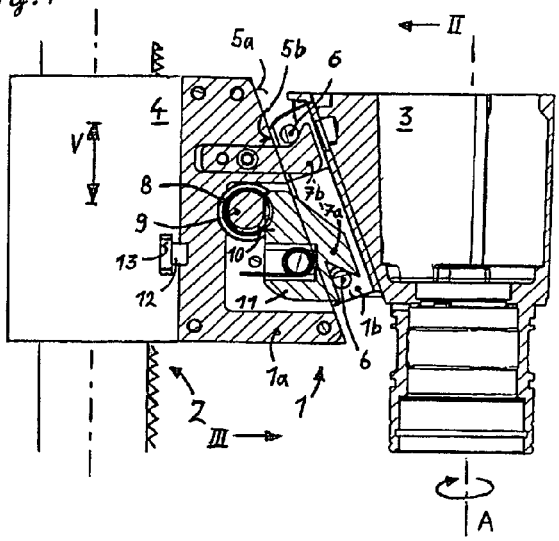
FIG. 1 a longitudinal cross-sectional view along line I-I in FIG. 2 of a stand according to the present invention for a portable power tool and having a tool coupling for securing the power tool on the stand.

A power tool stand 2, which is shown in FIG. 1, has a tool coupling 1 for a portable power tool 3 (shown only partially) that is formed as a core drill with a rotational axis A, and a guide carriage 4 for supporting the power tool 4 and displaceable in a displacement direction V. The tool coupling 1 is formed of a carriage coupling member 1*a* and an associated therewith, tool coupling member 1*b* for the power tool 3. Both the carriage coupling member 1*a* and the tool coupling member 1*b* are arranged on the guide carriage 4 and each has a clamping surface 5*a*, 5*b*, respectively, both inclined towards the displacement direction V of the guide carriage 4. The tool coupling member 1*b* has two free-lying, circumferentially arranged bolts 6 hanging behind two associated hooks 7*a*, 7*b* of the carriage coupling member 1*a*. The first hook 7*a* is displaceable along the clamping surface 5*a* of the carriage coupling member 1*a* by an eccentric mechanism. The eccentric mechanism is formed of a cylindrical sleeve 8 and a displaceable therein eccentric bolt 9. The eccentric bolt 9 has a radial, helically shaped contact surface 10 that applies pressure to a spring-biased, pivotally supported lever 11. The first hook 7*a* of the carriage coupling member 1*a* is formed on the lever 11. The second hook 7*b* of the carriage coupling member 1*a* is fixedly secured on the carriage coupling member 1*a*. A plurality of preloaded T-heads 12 are connected with the carriage coupling member 1*a*, engaging in T-shaped transverse grooves 13 extending in the displacement direction V of the guide carriage 4.

Figure 2:
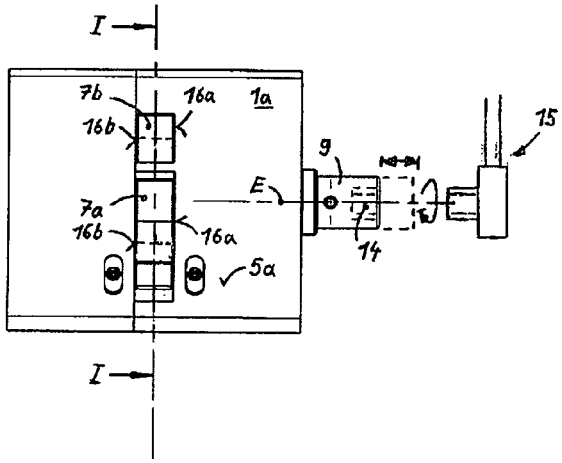
FIG. 2 a side view of the carriage coupling member in the direction of arrow II in FIG. 1.
Figure 3:
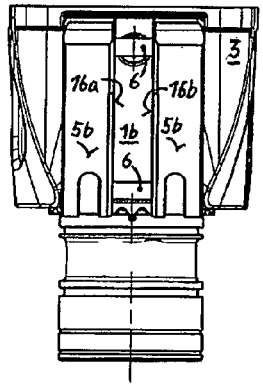
FIG. 3 a side view of the tool coupling member together with the power tool in direction of arrow III in FIG. 1.

As shown in FIG. 2, the eccentric bolt 9, which is displaceable along its eccentric axis E transverse to the displacement direction V (FIG. 1), has an extending outwardly lever arm 14 in form of an inner square for receiving a correspondingly shaped lever 15. On both, the hooks 7*a*, 7*b* of the carriage coupling member 1*a* and on the tool coupling member 1*b*, which is mounted on the power tool 3, on both side of both bolts 6, there are formed, respectively, two oppositely arranged, guide surfaces 16*a*, 16*b* extending perpendicular to the clamping surfaces 5*a*, 5*b*.

Figure 4:
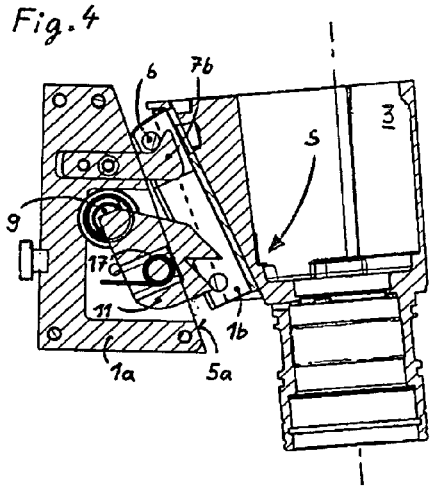
FIG. 4 a longitudinal cross-sectional view showing mounting of the power tool with the tool coupling.

According to FIG. 4, hanging of the tool coupling member 1*b*, which is inserted in the power tool 3 to a most possible extent, is effected by positioning the power tool 3 from above downwardly, firstly, with the bolt 6 in the second hook 7*b* and then by pivoting the power tools in a pivotal direction S in an abutting engagement with the clamping surface 5*a* of the carriage coupling member 1*a*. In the hanging position (shown in the drawings), the lever 11 pivots against a biasing force of a spring 17 until the (up to this moment pulled out) eccentric bolt 9 can be pushed sidewise along its eccentric axis E (FIG. 2) into the carriage coupling member 1*a* and engage, with its helically shaped contact surface 10 (FIG. 1) the lever 11 from behind. Thereby, the power tool 3 is secured but is not yet preloaded. The preloading takes place lately by rotation of the eccentric bolt 9.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A power tool stand, comprising a guide carriage (4); and a tool coupling (1) for a portable power tool (3) and including a carriage coupling member (1*a*) provided on the guide carriage (4), having a clamping surface (5*a*) and two hooks (7*a*, 7*b*) spaced from each other along the clamping surface (5*a*) with at least the first hook (7*a*) being displaceable along the clamping surface (5*a*), and a tool coupling member (1*b*) for the power tool (3) and having a clamping surface (5*b*) and connectable with the carriage coupling member (1*a*), the tool coupling member (1*b*) having two free-lying, arranged at least partially circumferentially, bolts (6) which can be hanged behind the two associated hooks (7*a*, 7*b*) of the carriage coupling member (1*a*).

2. A power tool stand according to claim 1, further comprising T-head means (12) for connecting the carriage coupling member (1*a*) with the guide carriage (4) and engaging in T-shaped transverse groove means (13) formed in the guide carriage (4) and extending perpendicular to a displacement direction (V) of the guide carriage (4).

3. A power tool stand according to claim 1, wherein the clamping surfaces (5*a*, 5*b*) of the carriage coupling member (1*a*) and the tool coupling member (1*b*) are inclined toward a displacement direction (V) of the guide carriage (4).

4. A power tool stand according to claim 1, further comprising an eccentric mechanism for displacing the first hook (7*a*) of the carriage coupling member (1*a*).

5. A power tool stand according to claim 4, wherein the eccentric mechanism is formed of a cylindrical sleeve (8) and an eccentric bolt (9) displaceable therein.

6. A power tool stand according to claim 4, wherein the first hook (7*a*) is formed on a lever (11) displaceable by the eccentric mechanism.

7. A power tool stand according to claim 4, wherein the eccentric mechanism has a lever receptacle (14) for receiving a lever (15).

8. A power tool stand according to claim 1, wherein the second hook (7*b*) is fixedly secured to the carriage coupling member (1*a*).

9. A power tool stand according to claim 1, wherein on both the tool coupling member (1*b*) and the carriage coupling member (1*a*), there are provided, respectively, oppositely arranged guide surface (16*b*, 16*a*) extending perpendicular to respective clamping surfaces (5*b*, 5*a*).

10. A tool coupling for mounting a portable power tool (3) on a guide carriage (4) of a power tool stand (2), the tool coupling comprising a carriage coupling member (1*a*) having a clamping surface (5*a*) and two hooks (7*a*, 7*b*) spaced from each other along the clamping surface (5*a*) with at least the first hook (7*a*) being displaceable along the clamping surface (1*a*), and a tool coupling member (1*b*) for the power tool (3) and having a clamping surface (5*b*) and connectable with the carriage coupling member (1*a*), the tool coupling member (1*b*) having two free-lying, arranged at least partially circumferentially, bolts (6) which can be hanged behind the two associated hooks (7*a*, 7*b*) of the carriage coupling member (1*a*).

11. A tool coupling according to claim 10, further comprising an eccentric mechanism for displacing the first hook (7*a*) of the carriage coupling member (1*a*).

12. A tool coupling according to claim 11, wherein the eccentric mechanism is formed of a cylindrical sleeve (8) and an eccentric bolt (9) displaceable therein.

13. A tool coupling according to claim 11, wherein the first hook (7*a*) is formed on a lever (11) displaceable by the eccentric mechanism.

14. A tool coupling according to claim 11, wherein the eccentric mechanism has a lever receptacle (14) for receiving a lever (15).

15. A tool coupling according to claim 10, wherein the second hook (7*b*) is fixedly secured to the carriage coupling member (1*a*).

16. A tool coupling according to claim 1, wherein on both the tool coupling member (1*b*) and the carriage coupling member (1*a*), there are provided, respectively, oppositely arranged guide surface (16*b*, 16*a*) extending perpendicular to respective clamping surfaces (5*b*, 5*a*).

17. A tool coupling according to claim 10, wherein the clamping surfaces (5*a*, 5*b*) of the carriage coupling member 1*a*) and the tool coupling member (1*b*) are inclined toward a displacement direction (V) of the guide carriage (4).

18. A tool coupling according to claim 10, further comprising T-head means (12) for connecting the carriage coupling member (1*a*) with the guide carriage (4) and engaging in T-shaped transverse groove means (13) formed in the guide carriage (4) and extending perpendicular to a displacement direction (V) of the guide carriage (4).

* * * * *